US011830387B2

(12) United States Patent
Xu et al.

(10) Patent No.: US 11,830,387 B2
(45) Date of Patent: Nov. 28, 2023

(54) WHEEL ROTATION IMAGING CONTROL SYSTEM

(71) Applicant: CITIC Dicastal CO., LTD., Hebei (CN)

(72) Inventors: Shiwen Xu, Qinhuangdao (CN); Minglei Li, Qinhuangdao (CN); Yao Dai, Qinhuangdao (CN); Shaoqian Wang, Qinhuangdao (CN); Weidong Liu, Qinhuangdao (CN); Xi Li, Qinhuangdao (CN)

(73) Assignee: CITIC DICASTAL CO., LTD., Hebei (CN)

( * ) Notice: Subject to any disclaimer, the term of this patent is extended or adjusted under 35 U.S.C. 154(b) by 317 days.

(21) Appl. No.: 17/172,890

(22) Filed: Feb. 10, 2021

(65) Prior Publication Data

US 2021/0375170 A1 Dec. 2, 2021

(30) Foreign Application Priority Data

May 28, 2020 (CN) ..... 202010467919.7

(51) Int. Cl.
*G09F 21/04* (2006.01)
*G09F 9/30* (2006.01)

(52) U.S. Cl.
CPC ..... *G09F 21/045* (2013.01); *G09F 9/30* (2013.01)

(58) Field of Classification Search
CPC ..... G09F 21/045; G09F 9/30; G09G 3/005; B60R 16/02; G08C 17/02
See application file for complete search history.

(56) References Cited

U.S. PATENT DOCUMENTS

2006/0038831 A1 2/2006 Gilbert
2007/0171664 A1 7/2007 Shih
2012/0200401 A1* 8/2012 Goldwater ..... G09F 21/045 340/432
2017/0026492 A1* 1/2017 Kawamura ..... H04L 67/61
2017/0176192 A1* 6/2017 Cardoso de Moura ..... H04W 4/024

(Continued)

FOREIGN PATENT DOCUMENTS

CN 107507544 A 12/2017
CN 110364097 A 10/2019
CN 110379348 A 10/2019

(Continued)

OTHER PUBLICATIONS

European Search Report in the European application No. 21156441.4, dated May 14, 2021, 6 pgs.

(Continued)

*Primary Examiner* — Donald L Raleigh
(74) *Attorney, Agent, or Firm* — Cooper Legal Group, LLC

(57) ABSTRACT

A wheel rotation imaging control system, including: a wheel rotation imaging apparatus, which can display images during wheel rotation; and a data processing apparatus, which can establish a connection with the wheel rotation imaging apparatus, process data related to the wheel rotation imaging apparatus, and control the wheel rotation imaging apparatus to image. By means of wireless connection, the present application can realize non-contact remote reading and configuration of internal parameters of a wheel rotation imaging device, remote control of media playback, and the like.

8 Claims, 3 Drawing Sheets

(56) References Cited

U.S. PATENT DOCUMENTS

2018/0178652 A1 6/2018 Monroe

FOREIGN PATENT DOCUMENTS

CN 110458614 A 11/2019
KR 20160089749 A 7/2016

OTHER PUBLICATIONS

First Office Action of the Chinese application No. 202010467919.7, dated Oct. 10, 2022, 12 pgs.
First Office Action of the Japanese application No. 2021-030294, dated Nov. 30, 2021, 8 pgs.
First Office Action of the European application No. 21156441.4, dated Jan. 31, 2023, 4 pgs.

* cited by examiner

WHEEL ROTATION IMAGING CONTROL SYSTEM

CROSS-REFERENCE TO RELATED APPLICATIONS

The present application claims benefit of Chinese Patent Application No. 202010467919.7, filed on May 28, 2020, the contents of which are hereby incorporated by reference in their entirety.

BACKGROUND

In today's rapid development in information technology, holographic advertising products of automobile wheels have become a research focus. Most domestic products are magnetic levitation LED wheel lights or solar wheel lights, which mainly function to light preset static patterns through LEDs, and has characteristics of small size, low power consumption, and static and single display content.

SUMMARY

The present disclosure relates to the field of vehicles, and specifically to a wheel rotation imaging control system.

In view of this, the present disclosure aims to provide a wheel rotation imaging control system, which can conveniently and flexibly realize the configuration of wheel rotation imaging display content and control media playback.

In order to achieve the above objective, the technical solution of the present disclosure is implemented as follows:

A wheel rotation imaging control system, including:

a wheel rotation imaging apparatus, which can display images during wheel rotation; and a data processing apparatus, which can establish a connection with the wheel rotation imaging apparatus, process data related to the wheel rotation imaging apparatus, and control the wheel rotation imaging apparatus to image.

In some embodiments, the data processing apparatus can read and configure parameter information of the wheel rotation imaging apparatus.

In some embodiments, the parameter information includes display parameters, and the display parameters include at least one of imaging resolution, image rotation direction, display lighting effect, control component and power supply type.

In some embodiments, the parameter information includes media play control parameters, and the media play control parameters include at least one of an imaging switch button, a media play button, a file control button and a media play list.

In some embodiments, the data processing apparatus establishes the connection with the wheel rotation imaging apparatus by means of a WiFi hotspot.

In some embodiments, the data processing apparatus can also log in to a cloud platform connected to the wheel rotation imaging apparatus to establish the connection.

In some embodiments, the data processing apparatus includes:

a wireless communication component, which can establish a connection with the wheel rotation imaging apparatus and transmit data thereto;

a read display component, which can read the parameter information of the wheel rotation imaging apparatus; and a configuration component, which can configure the parameter information of the wheel rotation imaging apparatus.

In some embodiments, the data processing apparatus includes a user terminal, and the user terminal includes at least one of a mobile terminal or a PC terminal.

In some embodiments, the user terminal further includes a counting apparatus, and the counting apparatus can perform counting when the user terminal sends instructions to the wheel rotation imaging apparatus.

In some embodiments, the counting apparatus includes a counter, and the counter can be set with a counting threshold.

Compared with the prior art, the wheel rotation imaging control system according to the present disclosure has the following advantages:

By means of wireless connection, the present disclosure can conveniently realize non-contact remote reading and configuration of internal parameters of a wheel rotation imaging device, remote control of media playback, and the like.

BRIEF DESCRIPTION OF THE DRAWINGS

The accompanying drawings constituting a part of the present disclosure are used for providing a further understanding of the present disclosure, and the schematic embodiments of the present disclosure and the descriptions thereof are used for interpreting the present disclosure, rather than constituting improper limitations to the present disclosure. In the drawings.

DETAILED DESCRIPTION

It should be noted that the embodiments in the present disclosure and the features in the embodiments can be combined with each other without conflicts.

The technical solutions of the present disclosure will be described clearly and completely with reference to the accompanying drawings and in combination with the embodiments. Apparently, the described embodiments are part of, not all of, the embodiments of the present disclosure. Based on the embodiments of the present disclosure, all other embodiments obtained by those of ordinary skill in the art without any creative effort shall fall within the protection scope of the present disclosure.

Figure 1:
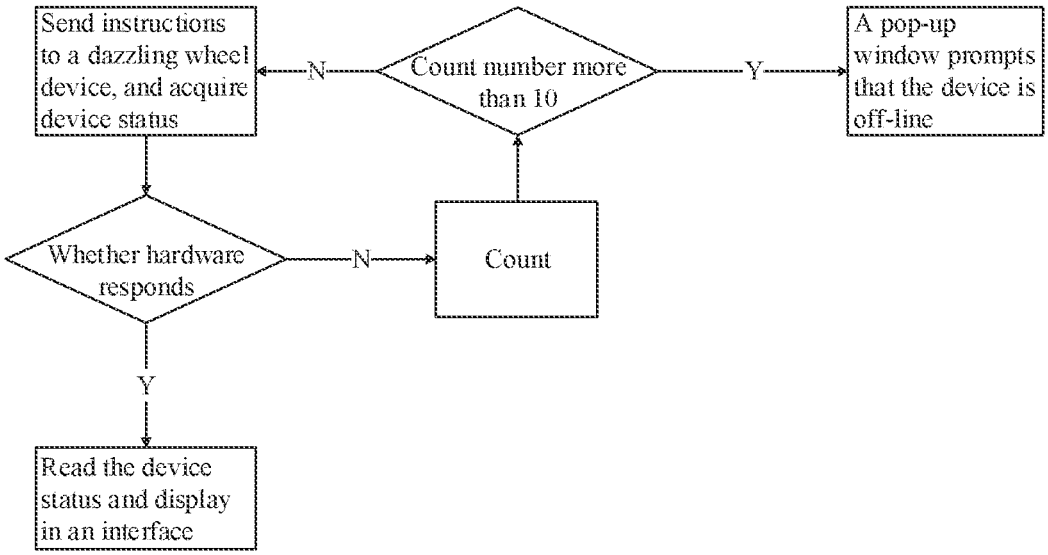
FIG. 1 is a schematic diagram of a wheel rotation imaging control system according to the present disclosure.

The wheel rotation imaging control system according to an embodiment of the present disclosure will be described with reference to FIGS. 1 to 3 and in conjunction with the embodiments.

A wheel rotation imaging control system includes: a wheel rotation imaging apparatus, which can display images during wheel rotation; and a data processing apparatus, which can establish a connection with the wheel rotation imaging apparatus by means of a WiFi hotspot, or log in to a cloud platform connected to the wheel rotation imaging apparatus to establish a connection, so as to process data related to the wheel rotation imaging apparatus. The data processing apparatus can read parameter information of the wheel rotation imaging apparatus, configure the parameter information of the wheel rotation imaging apparatus, and control the wheel rotation imaging apparatus to image.

The parameter information may be display parameters, which may specifically include, but are not limited to, one of or any combination of imaging resolution, image rotation direction, display lighting effect, control component, and power supply type of the wheel rotation imaging apparatus.

The parameter information may also be media play control parameters, which may specifically include, but are not limited to, one of or any combination of an imaging switch button, media play button, a file control button, and a media play list of the wheel rotation imaging apparatus. On and off of the wheel rotation imaging apparatus can be controlled, media play/pause/play of a previous file or play of a next file can be controlled, and files in the play list can also be added or deleted.

The data processing apparatus includes: a wireless communication component, a read display component and a configuration component; the wireless communication component can establish a connection with the wheel rotation imaging apparatus and transmit data thereto; the read display component can read and display the parameter information of the wheel rotation imaging apparatus; and the configuration component can configure the parameter information of the wheel rotation imaging apparatus.

The data processing apparatus may be a user terminal including mobile terminals such as a mobile phone and a tablet computer, or a PC terminal. By operating on the user terminal or the PC terminal, the wheel rotation imaging apparatus can be controlled.

The user terminal further includes a counter. The counter performs counting when the user terminal sends instructions to the wheel rotation imaging apparatus, and is set with a threshold. The sending of instructions may be suspended beyond the threshold, and a pop-up window prompts that the device is off-line. If a response is received within the threshold, the device status is read, and displayed in an interface.

In some embodiments, the wheel rotation imaging apparatus may be used as a hotspot, and the data processing apparatus is directly connected to the hotspot; or when the wheel rotation imaging apparatus has been connected to a cloud platform, the data processing apparatus first logs in to the cloud platform to find the wheel rotation imaging apparatus, and then takes over the wheel rotation imaging apparatus from the cloud platform.

After the data processing apparatus is connected to the wheel rotation imaging apparatus, the parameter information of the wheel rotation imaging apparatus is read. The internal parameter information of the device can be obtained by sending instructions to the wheel rotation imaging apparatus. During this process, the wheel rotation imaging apparatus may not be able to respond in time due to various reasons. Thus, a counter may be configured to send instructions multiple times. If the response of the wheel rotation imaging apparatus is received within a preset number of times, the parameter information of the wheel rotation imaging apparatus can be read. Otherwise, the wheel rotation imaging apparatus is prompted to be currently off-line, as shown in FIG. 1.

After connected to the wheel rotation imaging apparatus, the current media play information of the wheel rotation imaging apparatus can be read. For example, video files in a memory of the device can be browsed, and basic information such as currently played content, capacity of files in a list, and times of play can be checked.

Figure 2:
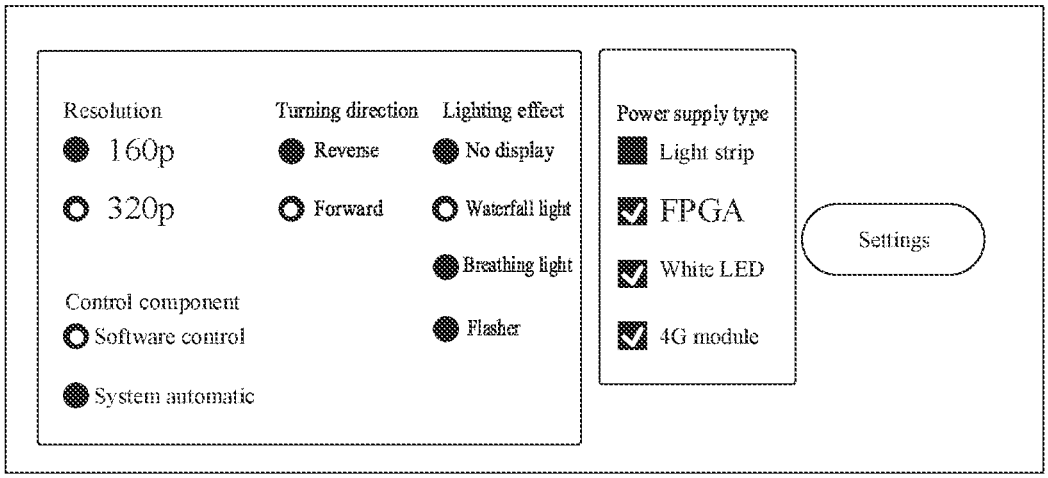
FIG. 2 is a schematic diagram of parameter information of the wheel rotation imaging control system according to the present disclosure.
Figure 3:
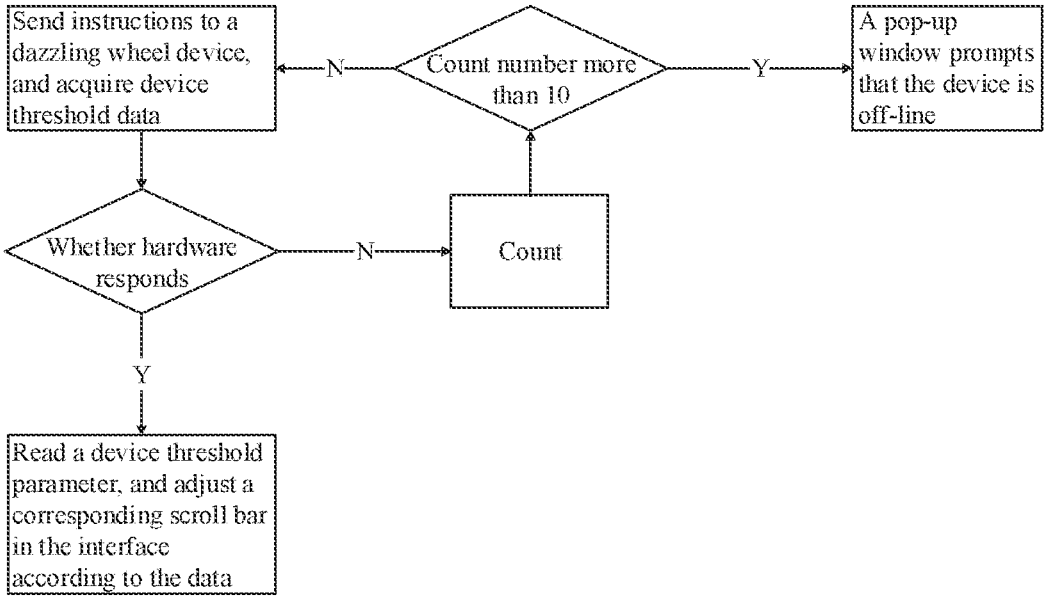
FIG. 3 is a schematic diagram of a threshold of the wheel rotation imaging control system according to the present disclosure.

The internal parameter information of the wheel rotation imaging apparatus is configured, as shown in FIG. 2, the configurable parameter information includes resolution, image rotation direction, display lighting effect, control component and power supply type. According to the specific product form of the wheel rotation imaging apparatus, some of these parameter items need to be configured separately, and some support multiple options for configuration.

The on-off state of the wheel rotation imaging apparatus can be configured, and the current playback action can be adjusted, for example, "play previous video", "play/pause", "play next video", add and delete files in the play list. The files in the play list can be downloaded and added from a material center of the cloud platform, and then saved locally.

After the configuration of parameters is completed, the parameters are sent to the wheel rotation imaging apparatus through the established connection.

In some embodiments, the wheel rotation imaging apparatus may have certain computing capabilities, for example, it may be configured with a counter. When the user terminal sends instructions to the wheel rotation imaging apparatus to obtain device parameter information, if the wheel rotation imaging apparatus responds, the parameter information of the device is read and displayed in the interface; if no response is received from the wheel rotation imaging apparatus, the counter starts counting; and if the count exceeds the set threshold 10 times, a pop-up window prompts the user terminal that the device is off-line.

Compared with the prior art, the wheel rotation imaging control system according to the present disclosure has the following advantages:

By means of wireless connection or indirect connection and diverse configurations of various parameters, the present disclosure can conveniently and flexibly realize non-contact remote reading and configuration of internal parameters of a wheel rotation imaging device, remote control of media playback, and the like.

In the description of the present disclosure, it should be understood that the terms "center", "longitudinal", "transverse", "front", "rear", "left", "right", "vertical", "horizontal", "top", "bottom", "inner", "outer", and the like indicate orientations or positional relationships based on the drawings. The terms are only for description convenience of the present disclosure and simplification of the description, but do not indicate or imply that the pointed apparatuses or elements must have specific orientations or be constructed and operated in specific orientations. Therefore, the terms should not be understood to limit the present disclosure.

Furthermore, the terms "first" and "second" are only for the sake of description, and cannot be understood as indicating or implying the relative importance or implicitly indicating the quantity of the indicated technical features. Thus, the features defined with "first" and "second" may explicitly or implicitly include one or more of these features. In the description of the present disclosure, "a plurality of" means at least two, e.g., two, three, etc., unless otherwise specified.

In the present disclosure, unless otherwise specified and defined, the terms "mounted", "joined", "connected", "fixed" and the like should be understood in a broad sense, for example, being fixedly connected, detachably connected, integrated, mechanically connected, electrically connected, mutually communicated, directly connected, indirectly connected by a medium, communication of interiors of two components or interaction of two components. A person of ordinary skill in the art could understand the specific meanings of the above terms in the present disclosure according to specific circumstances.

The foregoing descriptions are merely preferred embodiments of the present disclosure, but are not intended to limit the present disclosure. Any modification, equivalent substitution, improvement and the like made within the spirit and principle of the present disclosure shall fall within the protection scope of the present disclosure.

The invention claimed is:

1. A wheel rotation imaging control system, comprising:

a wheel rotation imaging apparatus, which is configured to display images during wheel rotation; and a data processing apparatus, which is configured to establish a connection with the wheel rotation imaging apparatus, process data related to the wheel rotation imaging apparatus, and control the wheel rotation imaging apparatus to image, wherein the data processing apparatus is configured to read and configure parameter information of the wheel rotation imaging apparatus, the parameter information comprising display parameters, the display parameters comprising imaging resolution, image rotation direction, display lighting effect, control component and power supply type, wherein the display lighting effect comprises waterfall light, breathing light and flasher.

2. The wheel rotation imaging control system according to claim 1, wherein the parameter information comprises media play control parameters, and the media play control parameters comprise at least one of an imaging switch button, a media play button, a file control button or a media play list.

3. The wheel rotation imaging control system according to claim 1, wherein the data processing apparatus establishes the connection with the wheel rotation imaging apparatus by means of a WiFi hotspot.

4. The wheel rotation imaging control system according to claim 1, wherein the data processing apparatus is also configured to log in to a cloud platform connected to the wheel rotation imaging apparatus to establish the connection.

5. The wheel rotation imaging control system according to claim 1, wherein the data processing apparatus comprises:

a wireless communication component, which is configured to establish the connection with the wheel rotation imaging apparatus and transmit the data to the wheel rotation imaging apparatus;

a read display component, which is configured to read the parameter information of the wheel rotation imaging apparatus; and a configuration component, which is configured to configure the parameter information of the wheel rotation imaging apparatus.

6. The wheel rotation imaging control system according to claim 5, wherein the data processing apparatus comprises a user terminal, and the user terminal comprises at least one of a mobile terminal or a personal computer (PC) terminal.

7. The wheel rotation imaging control system according to claim 6, wherein the user terminal further comprises a counting apparatus, and the counting apparatus is configured to perform counting when the user terminal sends instructions to the wheel rotation imaging apparatus.

8. The wheel rotation imaging control system according to claim 7, wherein the counting apparatus comprises a counter, and the counter is configured to be set with a counting threshold.

* * * * *